US005346206A

United States Patent [19]

Steinhart

[11] Patent Number: 5,346,206

[45] Date of Patent: Sep. 13, 1994

[54] PROCESSING A STREAM OF IMBRICATED PRINTED PRODUCTS INTO SUCCESSIVE STACKS

[75] Inventor: Horst Steinhart, Huntington Beach, Calif.

[73] Assignee: Rima Enterprises, Inc., Huntington Beach, Calif.

[21] Appl. No.: 816,189

[22] Filed: Jan. 2, 1992

[51] Int. Cl.[5] ..... B65H 31/24

[52] U.S. Cl. ..... 271/305; 271/182; 271/202; 271/216; 271/223

[58] Field of Search ..... 271/182, 183, 202, 203, 271/305, 151, 216, 280, 290, 223; 414/788.3, 791.1, 793.9

[56] References Cited

U.S. PATENT DOCUMENTS

| | | | |
|---|---|---|---|
| 1,489,166 | 4/1924 | Spiess . | |
| 2,375,241 | 5/1945 | Lindgren et al. . | |
| 2,576,956 | 12/1951 | Matthews . | |
| 3,166,206 | 1/1965 | Porter | 414/788.3 X |
| 3,264,917 | 8/1966 | Califano et al. . | |
| 3,430,950 | 3/1969 | Marsh et al. . | |
| 3,550,493 | 12/1970 | Benbenek et al. . | |
| 3,603,586 | 9/1971 | Hupfauf . | |
| 3,623,722 | 11/1971 | Sjogren et al. . | |
| 3,683,758 | 8/1972 | Feldkamper . | |
| 4,140,234 | 2/1979 | Steinhart . | |
| 4,183,704 | 1/1980 | Steinhart . | |
| 4,235,434 | 11/1980 | Müller . | |
| 4,302,198 | 11/1981 | Kawada . | |
| 4,447,052 | 5/1984 | Müller . | |
| 4,547,112 | 10/1985 | Steinhart . | |
| 4,569,513 | 2/1986 | Backman | 271/189 |
| 4,720,229 | 1/1988 | Steinhart . | |
| 4,770,406 | 9/1988 | Bodewein | 271/233 |
| 4,805,894 | 2/1989 | Scherer | 271/305 X |
| 4,938,657 | 7/1990 | Benson et al. . | |

FOREIGN PATENT DOCUMENTS

| | | |
|---|---|---|
| 2330614 | 1/1975 | Fed. Rep. of Germany . |
| 1445913 | 8/1976 | United Kingdom . |

OTHER PUBLICATIONS

The AF500/AV500 Stacking System Brochure, Ferag.
The Stacking System Brochure, Ferag.
Diagram of Feraq AV-500 System, p. 14 of unknown Feraq document.

*Primary Examiner*—Richard A. Schacher
*Attorney, Agent, or Firm*—Knobbe, Martens, Olson & Bear

[57] ABSTRACT

A product handling system for stacking printed products. The system includes a plurality of product stacking bins, a conveyor, a gapper and a plurality of diverters. In a preferred embodiment, the stacking bin is a compensating stacking bin including a temporary holding device which drops products onto a platform after a predetermined number of products have accumulated therein, a compression device which compresses the product stack on the platform, a compensation device which rotates the product stack on the platform and a product pusher device which pushes the product stack off of the platform. The system also includes a control processor to control the system. The diverter of the present invention has a low profile and can be integrated with a stacker conveyor. The system is actuated by pneumatic power.

51 Claims, 7 Drawing Sheets

A
B
104
106

130
134
136
138
102
104
106
120
122
124
126
174
176

140
141
143
162
164
168
170
172
188

PROCESSING A STREAM OF IMBRICATED PRINTED PRODUCTS INTO SUCCESSIVE STACKS

BACKGROUND OF THE INVENTION

1. Field of the Invention

The present invention relates to stacking machines for printed products, and more particularly to a system and method for processing a stream of printed products arriving in an imbricated, or partially overlapping, stream into successive stacks.

2. Description of the Related Art

Printed products (also referred to as "products"), such as books, newspapers, magazines and pamphlets are produced in a printing, binding or collating business. Printing presses provide printed product to delivery equipment, such as conveyers or continuous moving belts, in an imbricated, or partially overlapping stream where the delivery equipment is maintained at a constant speed of up to 70,000 copies per hour. The delivery equipment frequently leads to a stacking machine where a preset number of products forms a stack and becomes ready for further processing or transportation.

The stacking machine may include an assembly to collect the product, an assembly to then process the collected stack, such as rotation or compression, and finally an assembly to push the stack out for further disposal. These steps are repeated in rapid cycles as long as product is delivered to the stacking machine by the conveyor. With the stacking machines known today, a minimum of about one second is necessary to dispose of a finished stack. During this one second interval, given present maximum delivery speeds, 19 products pass a given point in the stream and must therefore be stacked.

The present stacking machines are sufficient if it is desired to only make stacks of more than or equal to a certain quantity, which is dependent on the conveyor speed, e.g., 19 at a speed of 70,000 copies per hour. Furthermore, current stackers can provide a stack less than this number, or a low quantity stack, so long as the next stack to be made is not also a low quantity stack. However, there is a problem when stacks of low quantity need to be made continuously because disposing of one full stack cannot be completed fast enough for a stacking machine to cycle for another disposal cycle. This problem is highlighted whenever two or more stacks of low quantity are necessary in succession, such as in the case of when a mail sorting line encounters consecutive, sparsely populated zip codes.

Books, newspapers, magazines, pamphlets, and so forth, having folded or stapled sheets, or a combination thereof, typically have one edge which is somewhat thicker than the other edges. When such products are stacked in the same orientation, the connected edges build up faster than the free edges to a point where the stack is unstable and difficult to handle. A compensating stacker, such as the one disclosed in U.S. Pat. No. 4,547,112, which includes a temporary product holding assembly, a revolving platform, a compression assembly, and a pusher assembly, is used to mitigate this height differential. The temporary product holding assembly collects a temporary stack of products from a continuous infeed supply while the pusher moves a completed stack from the platform or while a partial work stack is compensated. The compensation step compresses the connected edges to flatten the stack of products and offsets successive layers by rotating the platform.

In the compensating stacker disclosed in the '112 patent, the temporary product holding assembly is disposed directly above the platform and is formed by a plurality of tines connected with rotatable shafts. After a predetermined number of products has been collected on the temporary holding assembly, the products are dropped onto the platform and a set of retractable compression rods is extended over the platform. The temporary product holding assembly then returns to a collecting position for receiving further products. The platform is thereafter raised to press the products on the platform against the retractable compression rods extended over the platform resulting in a flattening of the relatively thicker, connected edge of the products. While the products are being pressed against the compression rods, the platform is rotated through up to 180° from its initial position. This rotation results in the relatively thick edges of the products in one portion of the stack being offset from the relatively thick edges of products in another portion of the stack. When a stack on the platform has the desired number of products, the pusher is actuated to push the stack from the platform for further handling, e.g., tying, wrapping, boxing, labelling. Since the stacker can stack products of various widths, the stack pusher has an adjustable travel length in relation to the width of the stack to be pushed from the platform.

Groups of paper sheets may be delivered from a printing press or another suitable source to various processing or consuming machines via a transporting system, or delivery equipment. A system which intermittently delivers sheets to consuming machines is disclosed by Müller (U.S. Pat. No. 4,235,434). The system includes a group forming device that gaps a continuous, scalloped stream of paper sheets. In the event of a malfunction in a processing or consuming machine, the group of sheets advances along a main path of the transporting system to a surplus receiving unit or overflow. A set of diverter switches drop the sheets into magazines for one or more consuming machines, over separate conveyor belts, or to one or more surplus receiving units. Consuming machines can deliver sheets to or may constitute gathering machines, collating machines, or other types of processing machines. The diverter switches are moved by fluid operated devices. A signal generating sensor, upstream of the switches, is a conventional counter which controls the operation of the group forming device. The group forming device is said to divide the continuous stream of sheets into a single file of discrete groups or streams.

The Müller '434 system uses a group forming device and diverter switches to process multiple stacks. However, the bins for the consuming machines or surplus receiving units do not have any compression means and compensation or rotation means to efficiently process products having one edge thicker than other edges. Moreover, the discrete streams are of identical length and contain identical numbers of partially overlapping sheets. Furthermore, the accumulations of numerous fully or nearly fully overlapping sheets at the leading ends of the discrete streams can interfere with introduction of discrete streams into the magazines of various processing machines.

Frequently when dealing with printed sheets or copies such as newspapers, the number of newspapers to be delivered to a dealer is not always a multiple of the number, e.g., 25, constituting one bundle. A machine to provide bundles containing odd copies, i.e., copies of a number less than 25, is disclosed by Kawada (U.S. Pat. No. 4,302,198). The Kawada machine includes a counter stacker having a counter head for counting copies in a scalloped stream. A first dividing plate, located downstream from the counter, is inserted into the stream (using an air cylinder) to stop subsequent copies. When the disclosed machine is diverting the stream to a second path, a second dividing plate is lowered, the stream is gapped by the first plate, and then the second plate is raised. A first stacking bin, receiving products from a first path, includes a turntable and a pusher. The second stacking bin, receiving products from the second path, includes a pusher.

Kawada discloses using a second stacking bin to accommodate stacks of less than 25 copies. Kawada also indicates that the end structures of the first and second paths may be replaced with each other. However, Kawada does not address consecutively low quantity stacks. Moreover, the machine does not have true modularity in that the first stacking bin is different from the second stacking bin. Furthermore, due to the lack of modularity, the machine is not expandable to more than two stacking bins.

An assembly for selectively transporting a stream of partly overlapping paper sheets or the like from a first path into one of several additional paths is important in the printed paper business. One assembly to prevent the accumulations of fully overlapping sheets at the leading end of discrete streams is disclosed by Müller (U.S. Pat. No. 4,447,052). Müller '052 describes a machine that selectively routes a scalloped stream from a first path to either a second or third path. When the stream is routed from the first path to the second path, a switching device, operated by a double-acting pneumatic cylinder, is lowered over a gap. A blade-like member, controlled by a fluid operated unit, is lowered to form a gap in the stream. At the instant when a sheet has its trailing edge over the switching device, the switching device is raised. Meanwhile the intercepted sheet is allowed to travel down the third path to a magazine of a gathering machine.

The Müller '052 machine uses a switching device to prevent accumulations of fully overlapping sheets at the leading ends of discrete streams. However, Müller only describes one switching device and its interaction with the blade-like member used to form a gap so as to form two streams. Moreover the use of stackers is not described. The machine does not have the ability to do direct stacking of the scalloped stream into successive low quantity stacks.

In a newspaper stacking plant, stacks of less than 17 copies were made by hand. An assembly to enable machine stacking of small stacks (less than 17 copies), including a stack size of one or several copies, is disclosed by Backman (U.S. Pat. No. 4,569,513). The Backman assembly includes an interceptor device that is controlled by a sensor to interrupt a flow of overlapping newspapers. Another interceptor device provides a gap in the flow of newspapers. Pushers push their respective stacks from tables.

Backman discloses a way to create one low quantity (less than 17 copies in this invention) secondary stack. Backman also discusses use of rotation (compensation) on the primary stack. However, the assembly cannot consecutively process two or more, low quantity stacks (under 17 copies). Moreover, the Backman assembly cannot accommodate variablesized products. Additionally, the assembly does not use multiple, modular stacking bins that can compress a stack.

Thus, while the preceding patents discuss a transporting assembly (or delivery equipment) with a device to gap and divide the incoming product stream and a diverter device to send the diverted products down another path, and two of the patents disclose systems using a stackers with a pusher device, none of them address the use of multiple, modular compensating stacking bins and coplanar diverters to produce successive, low quantity stacks of various product sizes.

Consequently there is a need for a modular system having a plurality of compensating stacking bins, diverters, and a single gapper such that successive, low quantity stacks can be produced without slowing, and independent of, the delivery equipment or transporting assembly. There is also a need for such a system to accommodate a variety of product sizes.

SUMMARY OF THE INVENTION

An object of the present invention is to provide a modular stacker having multiple stacking bins connected by coplanar diverters. A modular design allows the user to configure the system by purchasing a stacker with as many stacking bins as necessary to accommodate consecutive low quantity stacks.

Another object of the present invention is to permit the consecutive stacking of variable-sized products, e.g., 4 inches to 13 inches in one direction and 5 to 20 inches in the other direction. Thus, in the present invention, the user is offered a choice of product sizes to run through the system.

A further object of the present invention is to maintain high press or binding speed while providing for multiple low quantity stacks. The speed does not need to be reduced when running multiple, consecutive low quantity stacks.

In one aspect of the invention, there is a product handling system having a plurality of product stacking bins, a conveyor for moving products from a product source to a first one of the stacking bins, a gapper for selectively gapping the products on the conveyor, a plurality of diverters wherein each diverter selectively connects one stacking bin to the next stacking bin so that the stacking bins are serially connected and a control processor for controlling the activation of the gapper and the diverters.

In another aspect of the present invention, there is a system for stacking products having a plurality of identical product stacking bins, a means for receiving a plurality of overlapping products in a stream from a product source, a means for periodically gapping the stream so as to create a product stream, a means for periodically diverting the stacker stream to one of the stacking bins and a control processor for providing control signals to the gapping means and the diverting means.

In yet another aspect of the present invention, there is a stream diverter having a pneumatic cylinder, an actuating link connected on one end to the cylinder and a wedge connected to the other end of the actuating link so that linear motion of the cylinder is transferred to rotational motion of the wedge.

In still another aspect of the present invention, there is a method of diverting a stream of products in an assembly having a pneumatic cylinder, an actuating link, a wedge and a conveying means, the method comprising moving a cylinder shaft in the cylinder, linking the cylinder shaft to the wedge with the actuating link, pivoting the wedge in response to the motion of the cylinder shaft and conveying a stream of products downstream over the wedge and the conveying means.

Another aspect of the present invention includes a system having a gapper, and a plurality of substantially identical stacking bins and diverters, wherein there is defined a method of forming a plurality of product stacks from a product stream, the method comprising accumulating products from the product stream in a first one of the stacking bins, thereby forming a first stack, activating a first one of the diverters at a first predetermined point in the product stream, conveying a portion of the product stream downstream of the first activated diverter, actuating the gapper to gap the product stream at a second predetermined point in the product stream, accumulating products from the product stream in a second one of the stacking bins, thereby forming a second stack, activating a second one of the diverters at a third predetermined point in the product stream, conveying a portion of the product stream downstream of the second activated diverter and accumulating products from the product stream in a third one of the stacking bins, thereby forming a third stack.

DETAILED DESCRIPTION OF THE PREFERRED EMBODIMENTS

Figures 1A, 1B:
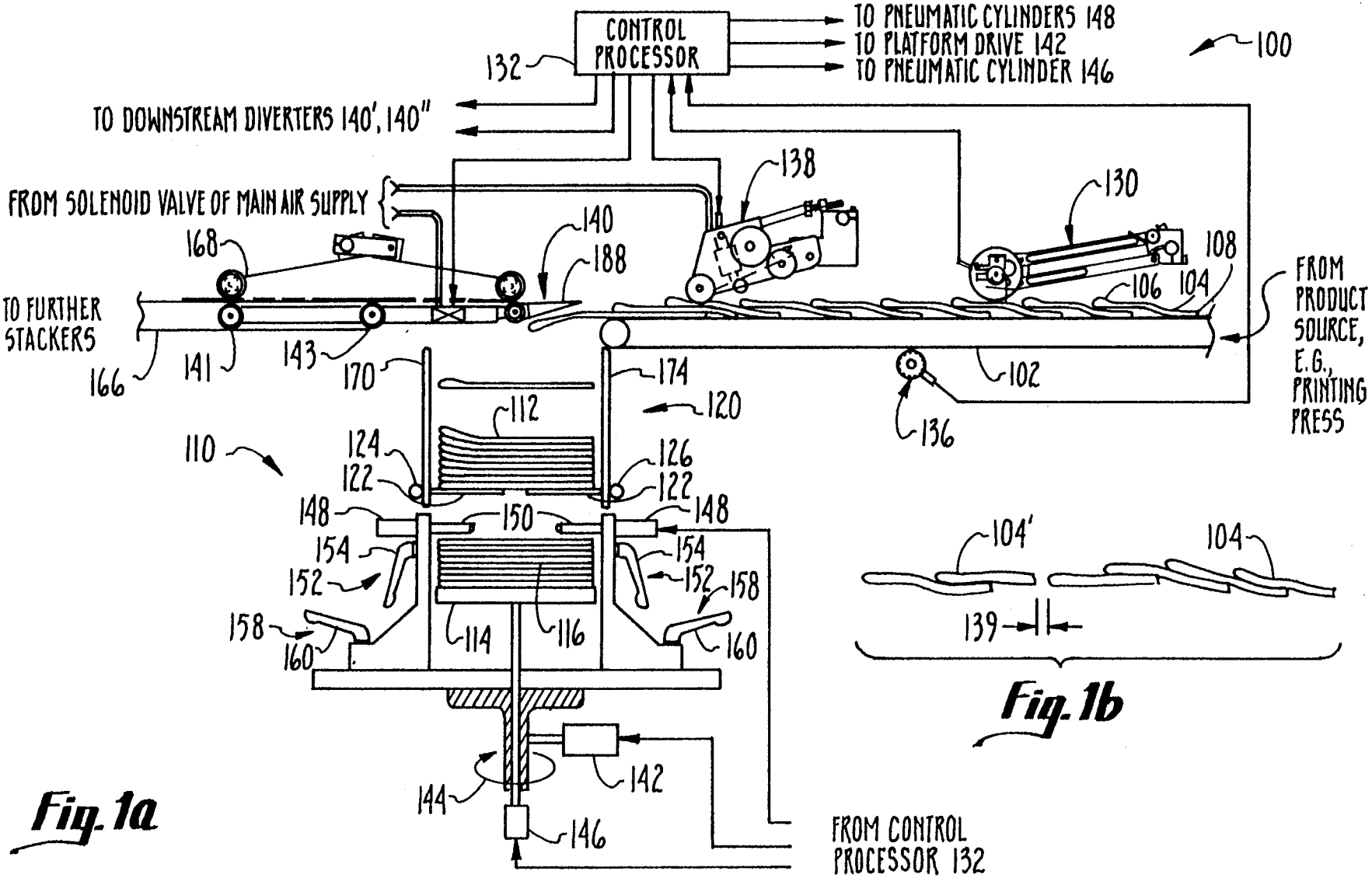
FIG. 1*a* is a schematic, side elevational view of a portion of a presently preferred product handling system of the present invention having a compensating stacking bin, a stream diverter, a gapper, a product counter, a high speed sensor, and a control processor.
FIG. 1*b* is a side elevational view of the product stream after a gap is formed by the gapper of FIG. 1*a;*

A portion of a presently preferred product handling system 100 is illustrated in FIG. 1*a.* The product handling system 100 includes an infeed conveyor 102 along which a set of printed products 104 are fed from a product source (not shown), such as a printing press, in an imbricated or partially overlapped relationship or stream with a connected edge 106, e.g., bound, folded, or stapled, downstream of an unconnected edge 108. The infeed conveyor 102 is typically powered by a variable speed electric motor (not shown). The products 104 have a width which may vary among different stacking runs.

The products 104 are fed from the infeed conveyor 102 to a compensating product stacking bin 110 to form a temporary stack 112. The compensating stacking bin 110 drops one or more of these temporary stacks 112 onto a platform or table 114, and after further processing produces a generally rectangular and relatively stable work stack 116 having a desired quantity of products 104. A pusher assembly 118 (shown in FIG. 3) sequentially pushes the work stack 116 out for further handling such as stack bundling and distribution to a loading dock for shipping via trucks. The preferred compensating stacking bin 110 is known in the technology and is disclosed in U.S. Pat. Nos. 4,140,234; 4,183,704; 4,547,112 and 4,720,229, which are hereby incorporated by reference.

The temporary stack 112 is created in a temporary product holding assembly 120. The temporary stack 112 is formed to allow the work stack 116 to be flattened, layered or pushed off the platform 114 without interfering in those operations while permitting continuous infeed of products 104. The temporary product holding assembly 120 includes a plurality of parallel flipper fingers or rods 122 which extend inwardly from a pair of rotatable shafts 124 and 126.

Figures 2A, 2B, 2C:
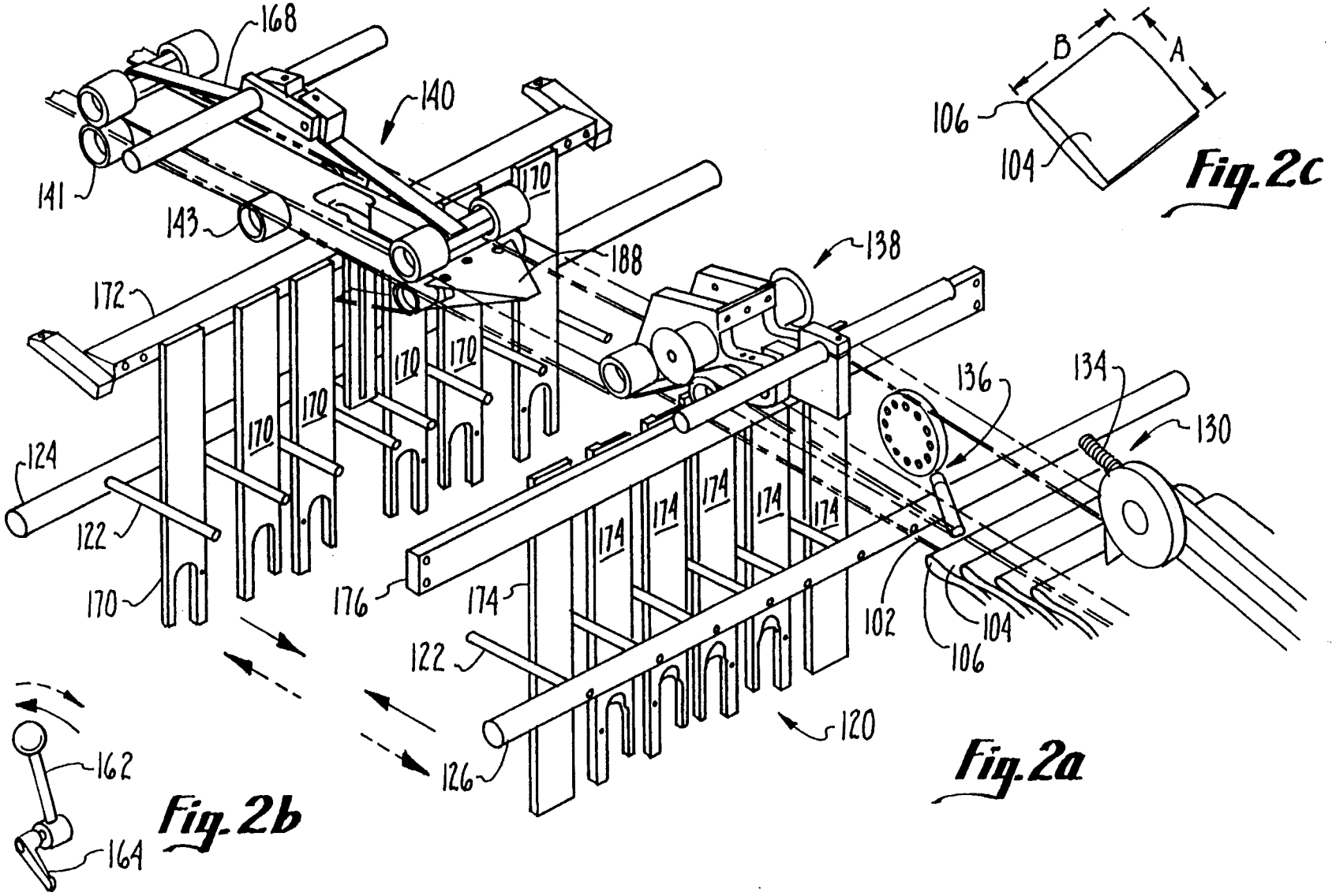
FIGS. 2*a,* 2*b* are a partial perspective view of the mechanical portion of the product handling system shown in FIG. 1*a;*
FIG. 2*c* is a perspective view of a product.

With reference again to FIG. 1*a,* a product counter 130 is mounted on the framework of the system 100 (framework not shown) at an upstream end of the infeed conveyor 102 and above the products 104. The counter 130 is used to count a predetermined number of products 104 which will form the temporary stack 112. The product counter 130 sends a signal to a controller, or control processor 132 each time the product 104 triggers a proximity switch 134 (shown in FIG. 2*a*) in the product counter 130. These signals are accumulated in a memory of the control processor 132 by use of a product count variable.

A high speed sensor 136, attached to the framework of the system 100 and underneath the conveyor 102, detects how fast the conveyor 102 is moving so as to synchronize operations of the control processor 132. The high speed sensor 136 includes a proximity switch and a sensing wheel driven by the infeed conveyor 102. The presently preferred high speed sensor 136 uses a fixed relationship of one-fourth inch of conveyor travel to one impulse of the sensing wheel, for example. A signal line connects the high speed sensor 136 to the control processor 132 to periodically communicate a signal, indicative of belt travel, to the processor 132.

A product or stream gapper 138 creates a gap 139 (shown in FIG. 1*b*) in the imbricated stream 104, creating a stacker stream 104'. This gap serves two main functions. First, the gap allows the shafts 124 and 126 (FIG. 1*a*) to rotate thereby separating the products into the temporary stack 112 and the work stack 116 (termed a "drop" operation). Additionally, the gap 139 allows a stream diverter or diverter gate 140 to penetrate the stream after it has already diverted the stream downstream, so that the stream can be diverted back to the first stacking bin 110. The gapper 138 is not used whenever the products 104 are diverted to a downstream stacking bin.

The product gapper 138 is attached to the framework of the system 100 downstream of the product counter 130 and above the products 104. The control processor 132 controls the operation of the product gapper 138 via a signal line. When signalled by the control processor 132 the gapper 138 activates to a lowered position to momentarily block the product stream and then is deactivated to a raised position to allow the product 104 to resume flow downstream to the stacking bin. Although not shown, the activation of the gapper 138 is controlled by a solenoid valve of a main air supply mounted on the system framework connected via a pneumatic line. The solenoid valve and main air supply are well known in the stacking technology.

The control processor 132, which coordinates the various components of the product handling system 100, includes (elements not shown) a programmable logic controller (PLC), preferably a 16-bit Mitsubishi FX-64MT, to execute a computer program stored in an EEPROM. The computer program stores the product count variable, a drop count, a compensate count and a total count. The product count was mentioned earlier in conjunction with the introduction of the product counter 130. The predetermined drop count constant is the number of products that will be accumulated in the temporary product holding assembly 120 before they are acted upon as described in the following paragraph. The product count variable, which is updated in the control processor 132 via the product counter 130, is repeatedly compared against the predetermined drop count value established by the user according to the application. The predetermined compensate count constant is used to limit the number of non-compensated products newly accumulated in the work stack 116. When the product count variable reaches the compensate count value, a rotation operation will occur as described hereinbelow. The predetermined total count constant limits the total number of products accumulated in the work stack 116. When the product count variable reaches the predetermined total count value, the product will be pushed off the platform 114.

The control processor 132 compares the predetermined drop count of the stacking bin 110 to the number of products tracked by the product count variable (which form the temporary stack 112). When the drop count has been reached, and when the compressing or compensating operations are not to be interfered with, the control processor 132 signals the temporary product holding assembly 120 to rapidly rotate the shafts 124 and 126 through 360°. The temporary stack 112 falls to either the existing work stack 116 or to an empty platform 114 below. The shaft 124 is rotated in a clockwise direction (as viewed in FIG. 1*a*) and the shaft 126 is rotated in a counterclockwise direction. The speed of rotation of the shafts 124 and 126 is such that the flipper fingers 122 are back in the position shown in FIG. 1*a* before the product which is to form the bottom of the next succeeding layer has dropped downwardly into the temporary product holding assembly 120.

After the temporary stack 112 has fallen to the platform 114, a platform drive assembly 142 receives a signal from the control processor 132 to rotate 180°, as indicated by arrow 144, if the predetermined compensate count value has been reached. The rotation alternates the location of the thicker portion 106 in layers in the work stack 116. By alternating temporary stacks, the bulkier connected edges are evenly displaced resulting in a more stable rectangular work stack 116.

Additionally, after the temporary stack 112 has fallen onto the platform 114 or the work stack 116, the control processor 132 signals a pneumatic cylinder 146 to raise the stack on the platform 114. Concurrently, the control processor 132 sends a signal to a set of pneumatic cylinders 148 to extend a plurality of compression rods 150. The raising of the stack against the compression rods 150 tends to flatten the work stack 116 making a more stable stack of products by removing air between the printed sheets. The platform 114 is then lowered a predetermined distance by the pneumatic cylinder 146, and the compression rods 150 are retracted to allow the next temporary stack 112 to fall. A detailed description of the operation of such a product handling system 100 is more fully described in U.S. Pat. No. 4,547,112.

The interchangeable platform 114 may be selected from various sized platforms which correspond to the length of the products 104 which are being stacked. This minimizes the distance which a work stack 116 must travel in order to be pushed off of the platform 114.

A length adjustment assembly 152 is used to accommodate various product lengths in the work stack 116. A clamp 154, included in the assembly 152, can be released to permit adjustment of positioning bars (not shown) to the length of the product 104. Similarly, a width adjustment assembly 158 can be used to vary the width of the work stack 116 by release of a clamp 160 included in the assembly 158. The width of the temporary stack 112 in the temporary product holding assembly 120 is also adjustable by use of an adjustment lever 162 (shown in FIG. 2*b*) in conjunction with a locking handle 164 mounted on the system framework (not shown).

The stream diverter 140 is located over the temporary product holding assembly 120 downstream of the product gapper 138. The location of the stream diverter 140 is adjustable upstream for narrow products and downstream for wider products to track the width of the assembly 120. The flipper rods 122 form the bottom of the temporary product holding assembly 120. The stream diverter 140 is controlled by the control processor 132 via a signal line to direct the flow of the product 104 to the stacking bin 110 or further down a stacker conveyor 166 to succeeding stacking bins.

Diverters similar in function to the preferred diverter 140 are known in the printing industry but the preferred diverter 140 has significant improvements in design over the existing diverting mechanisms. The main improvement is in the low profile of the diverter 140, slightly less than one inch, which allows the diverter to be placed directly in the path of the stream 104. The low profile allows the diverter 140 to be integrated with the conveying mechanism, i.e., the stacker conveyor 166, thereby eliminating the need for additional separate conveyors after diversion of the stream 104. Another improvement is the relatively few moving parts that make up the diverter mechanism, adding to the reliability of the mechanism. As illustrated in FIG. 1*a*, the stream diverter 140 includes a top conveyor assembly 168, a set of conveyor rollers 141 and 143 and a wedge-like flap 188 (also referred to as a wedge) at the upstream end. The diverter 140 is activated by the control processor 132 to move to a horizontal or down position to block the product 104 from falling in the stacking bin 110 and allow the product to be transported to a downstream stacking bin (e.g., stacking bin 110', FIG. 3). The diverter 140 is active for approximately 0.015 seconds. The control processor 132 will subsequently deactivate the diverter 140 moving to a raised position which then directs the product 104 into the stacking bin 110. Although not shown, the solenoid valve of the main air supply mounted on the system framework connects to the stream diverter 140 via a pneumatic line.

When the control processor 132 has determined that a predetermined number of products 104 comprises the work stack 116 (which means that the product count variable equals the total count value), the pusher assembly 118 (FIG. 3) is signaled to push the work stack from the platform 114. The work stack 116 may be pushed onto a delivery table or a belt assist conveyor (not shown). The compression and rotation, or compensation, operations are programmable by the user. For example, the user could choose to not execute the compensation operation and just push the product out or the compression operation can be completely disabled.

As shown on the perspective view of FIG. *2a*, a set of vertical alignment guides 170 are attached to a horizontal header bar 172 to form a downstream side of the assembly 120 and a set of vertical alignment guides 174 are attached to a horizontal header bar 176 to form an upstream side of the assembly 120. The shafts 124, 126 and the header bars 172, 176 attach to a framework (not shown) of the system 100.

FIG. *2c* illustrates one of the products 104 having a width (labelled A), e.g., 4 inches to 13 inches, and a length (labelled B), e.g., 5 inches to 20 inches. The connected edge 106 is the leading, downstream edge.

As previously described, the adjustment lever 162 and the locking handle 164 shown in FIG. *2b* are also mounted on the system framework. Release of the locking handle 164 permits the user to move the adjustment lever 162 so as to adjust the width of the assembly 120 as shown by the arrows. A linkage (not shown) connects the lever 162 to the horizontal header bars 172, 176 and shafts 124, 126 to make this adjustment. In addition, another similar lever (not shown) is used to adjust the location of the diverter 140, according to product width, as previously described.

Figure 3:
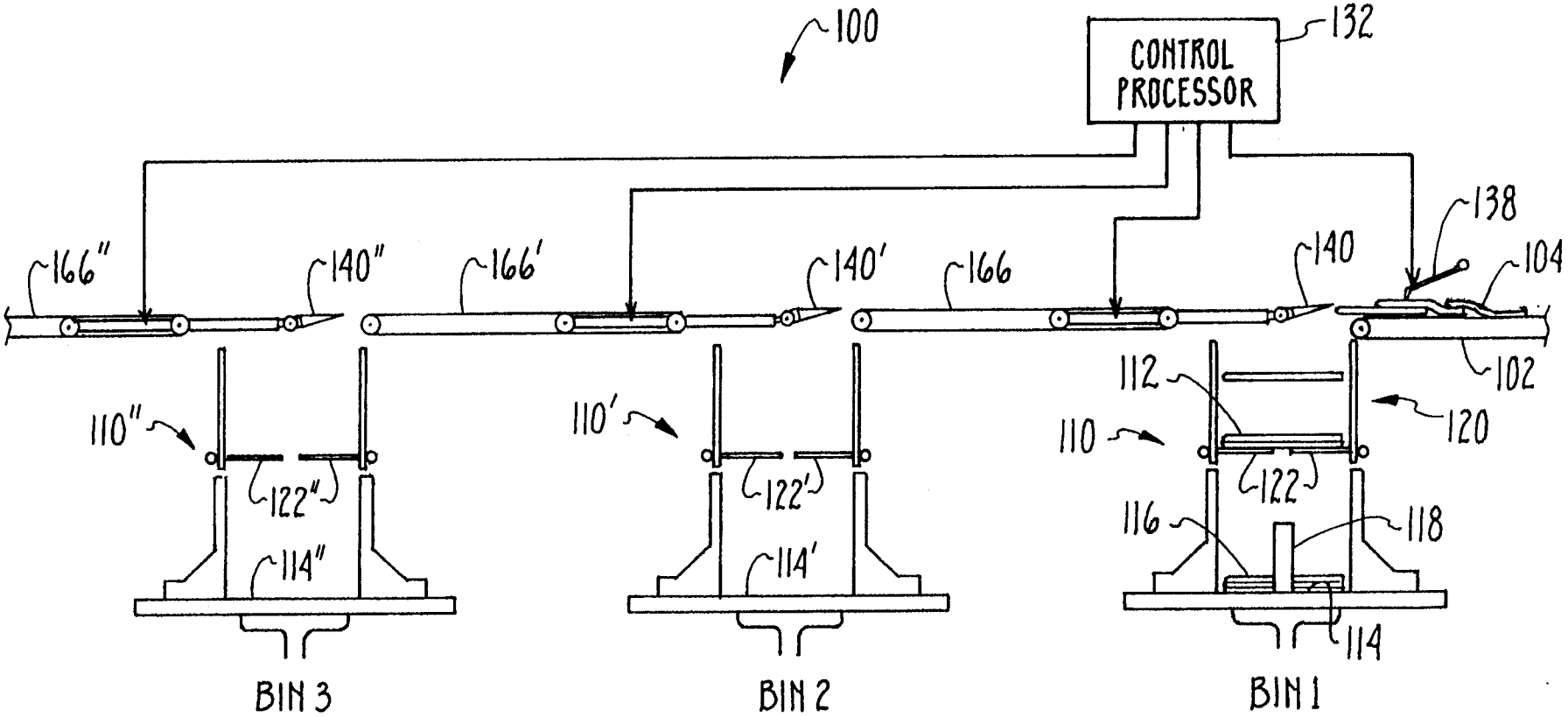
FIG. 3 is a schematic, side elevational view of a presently preferred product handling system having three modular stacking bins, according to the present invention.

In a preferred embodiment, the above-described compensating stacking bin 110 is used in a modular fashion as shown in FIG. 3 to allow stacking of a low quantity (e.g., less than 19) of products in succession. Although three compensating stacking bins are shown, any number of bins could be included in the system 100. In addition, it should be noted that the diverter 140, a diverter 140' and a diverter 140'' are coplanar to one another.

When the desired drop count (which is predetermined by the user) is reached in the first temporary product holding assembly 120, the products 104 are diverted to the downstream stacking bins in multiples of the drop count. The multiple is two when three stacking bins are in the system, or in general form, "Multiple=X-1", where "X" is the number of stacking bins in the system. When this multiple of the drop count is reached, the stream 104 is rediverted back to the first bin 110 following the rediversion procedure herein described. Although this is the preferred method of utilizing the multiple bins, introducing equal wear on the bins, the system 100 is not limited as such. With minimal modification, the system 100 can be made to utilize the bins in an "as needed" basis.

In an alternative embodiment, when the desired drop count (which is predetermined by the user) is reached in a first, or primary, compensating stacking bin and the next stack to be made is less than the theoretical minimum allowable stack size, e.g., 19 products at a speed of 70,000 copies per hour, the products are diverted to a similar, but identical in function, second compensating stacking bin until the first bin is ready to accept more products. Again, if the desired count is reached in the second bin and the next stack to be made is less than this same minimum count, then the product stream is again diverted to a third compensating stacking bin. This process can be repeated until all of the initially diverted product stream from the first stacking bin can be processed. In such an "as needed" embodiment, additional computational resources may be necessary.

In FIG. 3, the stream diverter 140 directs the flow of the product 104 to the first stacking bin or bin 110 (labelled Bin 1 in FIG. 3) or further down the stacker conveyor 166 to succeeding bins. For clarity in FIGS. 3 and 4, the top conveyor assembly 168 is not shown on the stream diverters and the stream gapper 138 is shown in symbolic form.

The second stream diverter 140', substantially identical to the first stream diverter 140, is controlled by the control processor 132 to direct flow of the product 104 to a second stacking bin 110' (referred to as bin 2 in FIG. 3) or further down a stacker conveyor 166'. The stacking bin 110' includes a set of flipper rods 122' and a platform 114' for creating temporary and working stacks of products.

The third stream diverter 140'' substantially identical to the first stream diverter 140, is controlled by the control processor 132 to direct flow of the product 104 to a third stacking bin 110'' (referred to as bin 3 in FIG. 3) or further down a stacker conveyor 166''. The stacking bin 110'' includes a set of flipper rods 122' and a platform 114'' for creating temporary and working stacks of products.

Figures 4A, 4B, 4C, 4D:
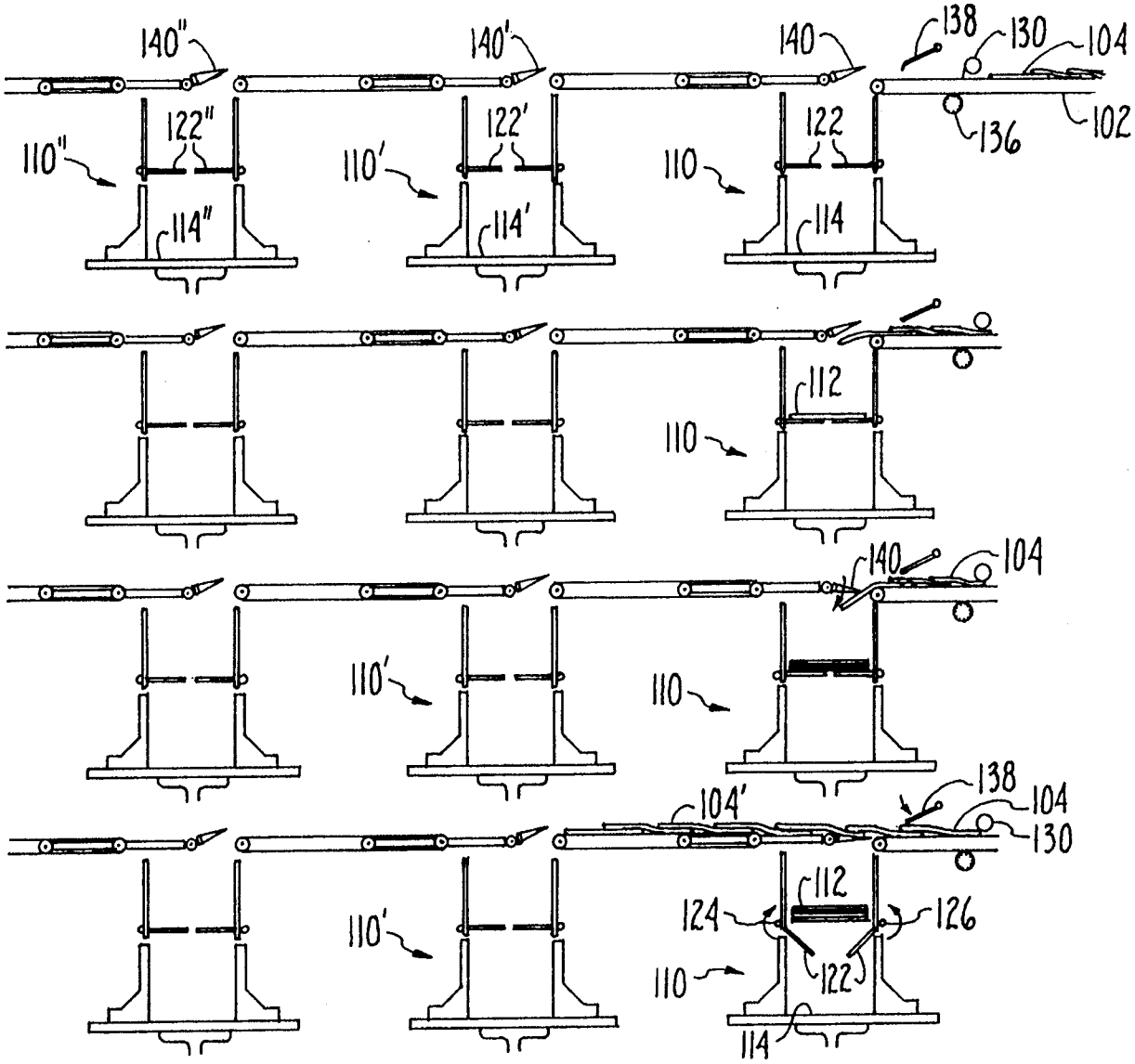
FIGS. 4*a,* 4*b,* 4*c,* 4*d,* 4*e,* 4*f,* 4*g,* 4*h* are a set of schematic, side elevational views, corresponding to FIG. 3, illustrating a sequence of process steps showing the operation of the product handling system having three stacking bins.

FIGS. 4*a*–4*h* illustrate one preferred sequence of process steps diagrammatically showing the operation of the product handling system 100. Although FIGS. 4*a*–4*h* show the operation of the system 100 without the compensation and compression steps, these two optional steps will be illustrated on the flow diagram of FIG. 5. FIG. 4*a* shows the product handling system 100 shortly after it has been powered on. The product 104 of the infeed stream is transported downstream on the conveyor 102 and is counted by the product counter 130. The stream or conveyor belt speed is monitored by the high speed sensor 136. The product gapper 138 and the coplanar stream diverters 140, 140', 140'' are all in an open or raised configuration. The flipper rods 122,122', 122'' are all in the closed or horizontal position ready to receive the product 104. The platforms 114, 114', 114'' are all in the lowered position.

FIG. 4*b* shows the product 104 starting to form the temporary stack 112 in the first bin 110. The second bin 110' and the third bin 110'' are idle, waiting to receive product.

FIG. 4*c* shows the product 104 accumulating in the first bin 110. The product count is increasing and, after the drop count is reached, the stream diverter 140 is actuated by the control processor 132 to a lowered or horizontal position. The stacker stream 104' is thereafter diverted downstream to the second bin 110'.

FIG. 4*d* shows the temporary stack 112 in the first bin 110 being dropped to the platform 114 by the rapid 360° rotation of the shafts 124 and 126 which causes flipper rods 122 to also rotate 360° from a closed position, through an open position, and back to a closed position. The stacker stream 104' of products proceeds toward the second bin 110'. After a programmed number of products 104 (e.g., two times the drop count) pass the product counter 130, the product gapper 138 is actuated to a down position to momentarily block the product stream, e.g., for approximately 0.050 seconds, creating the stream gap 139.

Figures 4E, 4F, 4G, 4H:
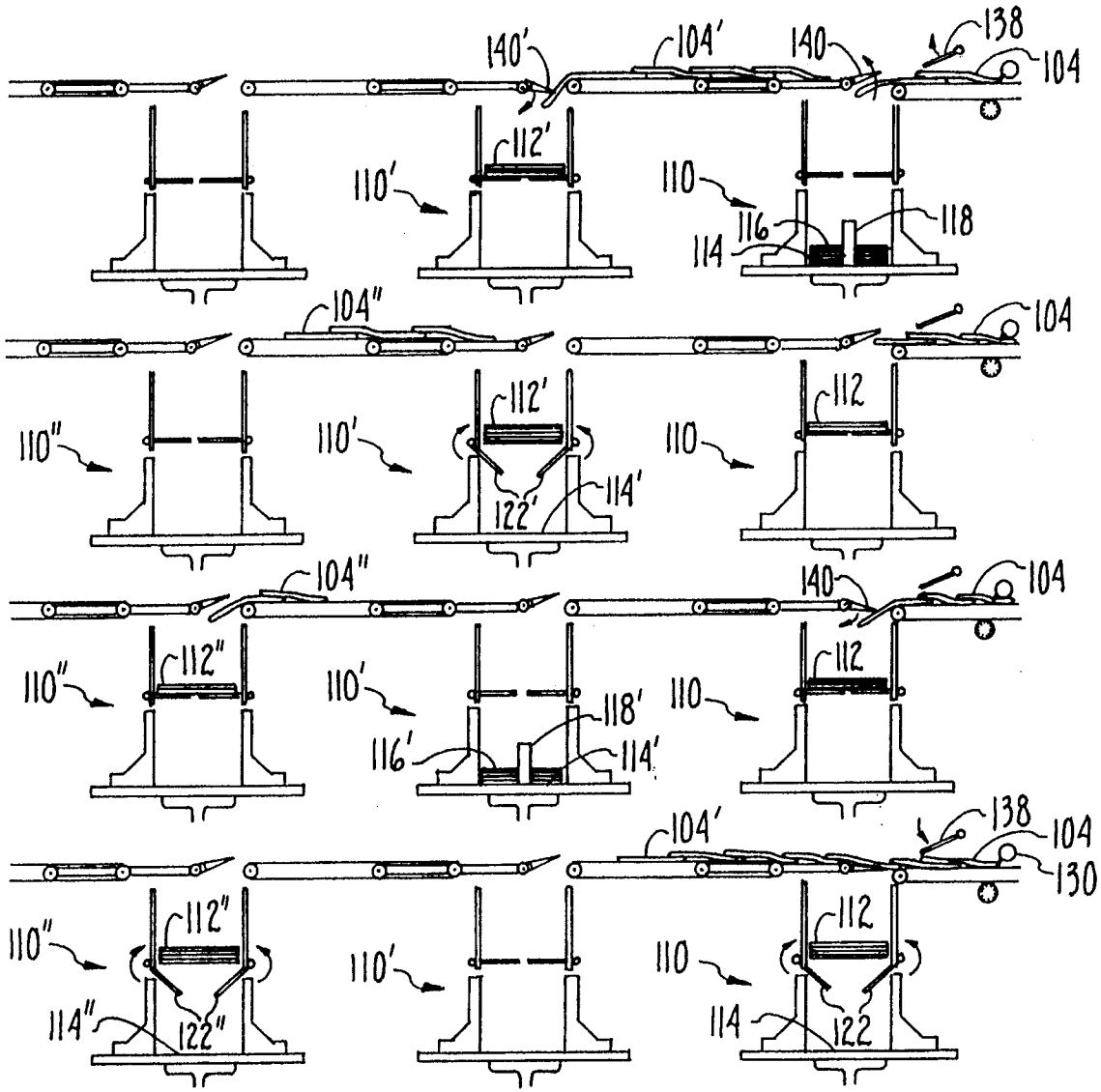

FIG. 4*e* shows the stream diverter 140 deactivated to the raised position, timed to break through the gap 139, and the gapper 138 also deactivated to the raised position. The pusher assembly 118 of the stacking bin 110 is activated by the control processor 132 to push out the work stack 116 on the platform 114. The drop count is reached in the second stacking bin 110' on a temporary stack 112'. The diverter 140' is then activated by the control processor 132 to the down position and a stacker stream 104'' is thereafter diverted downstream to the third stacking bin 110''.

FIG. 4*f* shows the product stream 104 starting to form the temporary stack 112 in the first bin 110. The temporary stack 112' in the second bin 110' is dropped to the platform 114' by the motion of the flipper rods 122'. The stacker stream 104'' proceeds toward the third stacking bin 110''.

FIG. 4*g* shows the first bin 110 as the drop count is reached on the temporary stack 112. The diverter 140 is then activated to the lowered position by the control processor 132 and the product stream is diverted downstream toward the second bin 110'. A pusher assembly 118' of the second stacking bin 110' is activated by the control processor 132 to push out a work stack 116' from the platform 114'. The product of the stacker stream 104'' continues to gather on a temporary stack 112'' in the third bin 110''.

FIG. 4*h* shows the temporary stack 112 dropped to the platform 114 in the first bin 110 by the motion of the flipper rods 122. After a programmed number of products 104 pass the product counter 130 (e.g., two times the drop count), the product gapper 138 is actuated to a lowered position to momentarily block the product stream. The stacker stream 104' downstream of the gapper 138 is transported toward the second bin 110'. The temporary stack 112'' is dropped to the platform 114'' in the third bin 110'' by the motion of the flipper rods 122'', ready to be pushed out.

Figure 5:
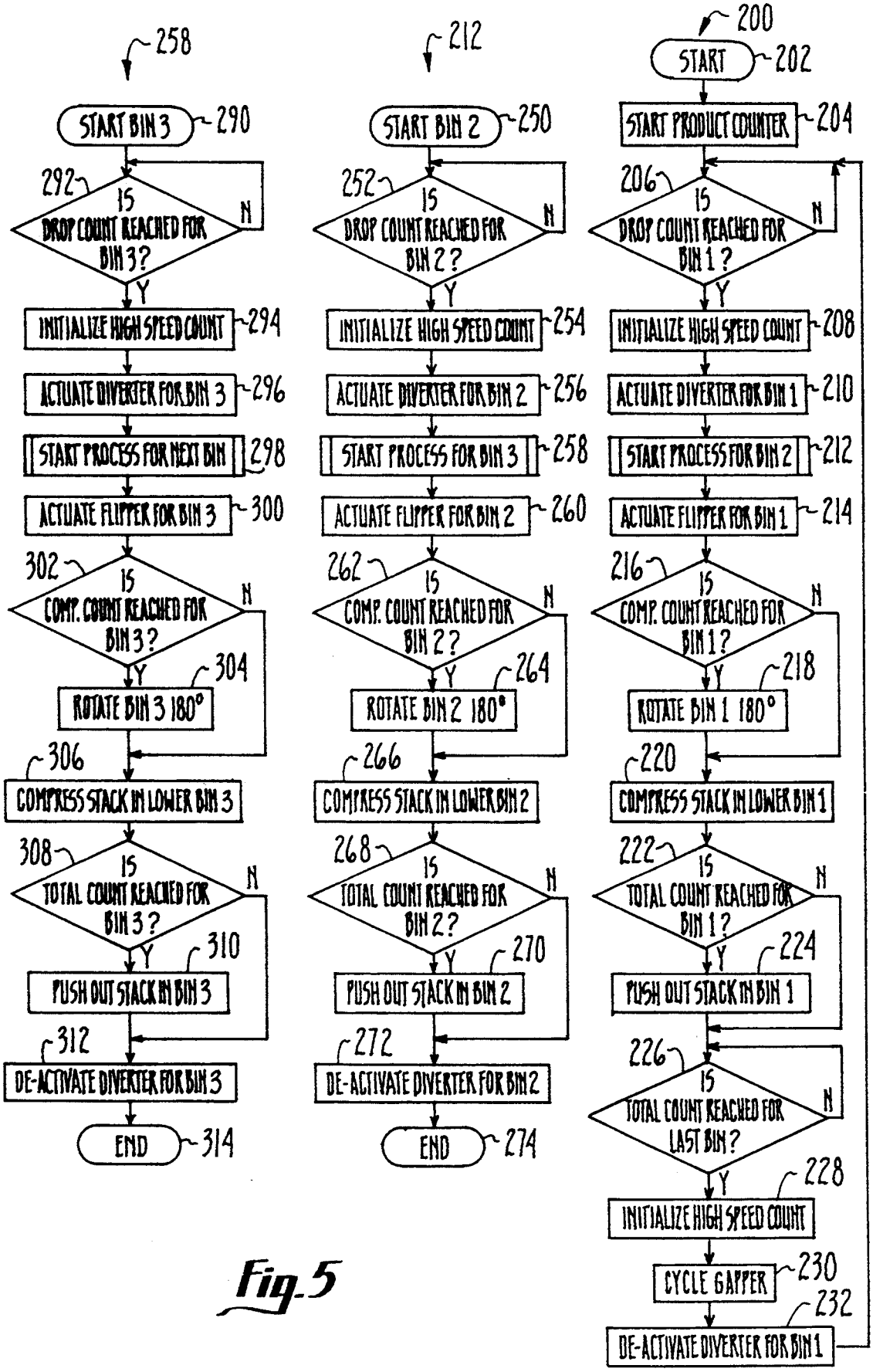
FIG. 5 is a flow diagram of the operation of the product handling system shown in FIG. 3.

FIG. 5 is the flow diagram illustrating the operation of the preferred product handling system 100 (FIG. 3). The control processor 132 (FIG. 1*a*) executes a product control program 200 that controls the operation of the system 100. The preferred program 200 is written in a relay symbolic language and a step ladder. Such programming language is specified by Mitsubishi, the vendor of the preferred FX-64MT programmable logic controller. Of course, other controllers and programming languages could be used to implement the control flow.

The program 200 defines certain variables including the product count, the drop count, the compensate count, the total count and the high speed count, which have been described earlier and are not shown on the drawings. The drop, compensate and total count variables are defined for each stacking bin or bin 110 in the system 100. Furthermore, product count variables for the second, third and subsequent bins are maintained by using the original product counter in a set of shift registers of the preferred control processor 132. In the preferred embodiment of the invention, the drop count value for each bin is identical, the compensate count value for each bin is identical and the total count value for each bin is identical. However, it is envisioned that in other embodiments the values of the variables may differ from bin to bin.

Referring to and discussing the flow diagram of FIG. 5, frequent reference will also be made to the components described in FIGS. 1 and 3. The product control program 200 begins execution at a state 202, upon power-up or reset, and moves to a state 204 where the product count variable for accumulating product count signals received from the product counter 130 (FIG. 1*a*) is cleared to zero initially. The product count variable is incremented by one each time the product counter 130 detects one of the products 104 passing on the conveyor 102. Moving to a decision state 206 a check is made to see whether the programmed value for the drop count of the first bin 110 (FIG. 3) has been reached. If the drop count has not been reached, the program 200 will return to state 206 to count more products 104 flowing past the product counter 130 as shown in FIG. 4*c*.

At state 206, when the drop count for the first bin 110 has been reached, the program 200 moves to a state 208 where the high speed count variable is initialized to zero. Subsequent travel of the conveyor 102 (FIG. 1*a*) at each one-fourth inch interval causes the high speed sensor 136 to send an impulse to the control processor 132 and therefore increment the high speed count. The high speed count allows the control processor 132 to synchronize operation of the system 100 independent of the conveyor travel speed.

An equation for the number of impulses from the high speed sensor 136 to the control processor 132 per product is: Impulses per Product=((Width−Overlap) / 0.25), where all terms are in inches. Overlap is the distance that one product 104 is covered or is overlaid by the next upstream product. Therefore, from the number of impulses per product, the control processor 132 can determine where a particular product is at all times.

In FIG. 3, the diverters 140, 140' and 140'' the flipper rods 122, 122' and 122'' and the gapper 138 are activated when different user programmed high speed counts are reached in the control processor 132 through impulses sent by the high speed sensor 136. The high speed counts for the diverters, the flipper rods and the gapper are changed automatically by the control processor 132 whenever a product is of a different width than the previous product run. Such flexibility allows the user to accommodate various widths of the product 104. Approximate example values of the high speed count will be used in this description of the flow diagram. The example values are based on a product that is $8\frac{1}{2}$ inches in width and has a $7\frac{1}{2}$ inch overlap. The example high speed count values are preferably prestored in memory.

Transitioning to a state 210, the product control program 200 waits for the high speed count to reach a value of 75 indicating that the conveyor 102 has traveled $18\frac{3}{4}$ inches, for example. Then, the diverter 140 (FIG. 3) for the first bin 110 is activated which will cause subsequent products 104 to flow downstream on the stacker conveyor 166. Immediately thereafter, a process for the second bin 110' is started by the program 200 at a function 212. The process for the second bin 110' (function 212) will be described after the remainder of the main process control flow defined by states 206–232 has first been discussed.

From the process initiation function 212, the product control program 200 continues to a state 214 to wait until the high speed count reaches a value of 77 in the above-defined example. In state 214, the flipper rods 122 (FIG. 3) for the first bin 110 are activated causing the temporary stack 112 to fall to the platform 114 as shown in FIG. 4*d*.

Next, the product control program 200 moves to a decision state 216 to test whether the programmed value for the compensate count of the first bin 110 has been reached. If the compensate count has been reached, the program 200 moves to a state 218 and controls the platformdrive assembly 142 (FIG. 1*a*) to rotate the platform 114 through 180°.

If the compensate count was not reached at state 216 or after completion of the compensation at state 218, the product control program 200 moves to a state 220. At state 220, the work stack 116 is raised by the pneumatic motor 146 (FIG. 1*a*) and compressed against the extended compression rods 150. The compression operation can be optionally disabled by the user via a predetermined program parameter. After stack compression, the program 200 continues to a state 222 to test whether the programmed value for the total count of the first bin 110 has been reached. If the total count has been reached control proceeds to a state 224 wherein the pusher assembly 118 for the first bin 110 pushes the work stack 116 off of the platform 114 as shown in FIG. 4*e*.

After the work stack 116 has been pushed out for further handling at state 224, or if the total count for the first bin 110 (FIG. 3) has not been reached at state 222, the program 200 moves to a decision state 226. At state 226, a check is made to determine if the total count for the last bin has been reached. In the embodiment illustrated by FIG. 3, the last bin is the third bin 110'' and the total count for the third bin 110'' is checked at a state 308. If the total count has not been reached for the third bin 110'', state 226 will feed back to itself under control of the program 200 and wait until the total count has been reached for the third bin 110'' and thereafter, the program 200 advances to a state 228.

At state 228, the high speed count is reset to zero and the control processor 132 starts accepting impulses from the high speed sensor again to increment the high speed count. The program 200 waits at state 228 until the high speed count reaches a value of 70, in the above-defined example. Moving to a state 230, the control processor 132 (FIG. 1*a*) momentarily activates the gapper 138 to the down position to block the product stream and then is deactivated to the up position to allow continued product flow.

The program 200 then proceeds from state 230 to a state 232 wherein the high speed count value is read from the appropriate memory location. After a high speed count value of 110 is reached, the diverter 140 for the first bin 110 is deactivated to the up position as shown in FIG. 4*e*. The break in the product stream caused by the cycling of the gapper 138 at state 230 allows the diverter 140 to be raised without disrupting the smooth flow of the products 104. With the diverter 140 in the raised position, the products 104 are directed into the first bin 110 and the product control program 200 loops back to the decision state 206 to test whether the drop count has been reached for the first bin 110.

The process for the second bin 110' identified in FIG. 5 as function 212, operates concurrently with the main process control flow. The process 212 begins at a start state 250 and moves to a decision state 252 wherein the second bin process 212 tests whether the programmed value for the drop count of the second bin 110' (FIG. 3) has been reached. If the drop count has not been reached, the process 212 will return to state 252 to wait for more products 104 to flow past the product counter 130. At state 252, when the drop count for the second bin 110' has been reached, the process 212 moves to a state 254 where the high speed count is initialized to zero and the control processor 132 starts accepting impulses from the high speed sensor 136 (FIG. 1*a*) and increments the high speed count accordingly.

Moving from state 254 to a state 256, after the high speed count reaches a value of 155, for example, the diverter 140' (FIG. 3) for the second bin 110' is activated at a state 256 which will cause subsequent products 104 to flow downstream on the stacker conveyor 166'. Immediately thereafter, a process for the third bin 110'' is started by the second bin process 212 at a function 258. The process for the third bin 110'' (function 258) will be described after the remainder of the second bin process 212 has first been discussed.

From the process initiation function 258, the process 212 continues to a state 260 to wait until the high speed count reaches a value of 157 in the above-defined example. In state 260, the flipper rods 122' (FIG. 3) for the second bin 110' are activated causing the temporary stack 112' to fall to the platform 114' as shown in FIG. 4*f*.

Next, the second bin process 212 moves to a decision state 262 to test whether the programmed value for the compensate count of the second bin 110' has been reached. If the compensate count has been reached, the process 212 moves to a state 264 and causes the platform 114' to rotate through 180°.

If the compensate count was not reached at state 262 or after completion of the compensation at state 264, the process 212 moves to a state 266. At state 266, the work stack 116' on the platform 114' is compressed. After stack compression, the process 212 continues to a state 268 to test whether the programmed value for the total count of the second bin 110' has been reached. If the total count has been reached, control proceeds to a state 270 wherein the pusher assembly 118' for the second bin 110' pushes the stack off of the platform 114' as shown in FIG. 4*g*.

After the work stack 116' has been pushed out for further handling at state 270 or if the total count for the second bin 110' (FIG. 3) has not been reached at state 268 (i.e., the second stacking bin awaits product from a later stacker stream 104' the second bin process 212 moves to a state 272. At state 272, the diverter 140' for the second bin 110' is deactivated to the up position. The process 212 then moves to an end state 274 wherein the process for the second bin 110' terminates.

The process for the third bin 110'' identified in FIG. 5 as function 258, begins at a start state 290 and moves to a decision state 292 wherein the third bin process 258 tests whether the programmed value for the drop count of the third bin 110'' (FIG. 3) has been reached. If the drop count has not been reached, the process 258 will return to state 292 to wait for more products 104 to flow past the product counter 130. At state 292, when the drop count for the third bin 110'' has been reached, the process 258 moves to a state 294 where the high speed count is initialized to zero and the control processor 132 starts accepting impulses from the high speed sensor 136 (FIG. 1*a*) and increments the high speed count accordingly.

Moving from state 294 to a state 296, after the high speed count reaches a value of 235, for example, the diverter 140'' (FIG. 3) for the third bin 110'' is activated at a state 296 which will cause subsequent products 104 to flow downstream on the stacker conveyor 166''. Immediately thereafter, a process for a succeeding bin (if there are additional bins) is started by the process 258 at a function 298. Although not shown, function 298 and additional functions, if additional bins are configured in the system, would be similar to function 258 for the third bin 110".

From the process initiation function 298, the third bin process 258 continues to a state 300 to wait until the high speed count reaches a value of 237 in the above-defined example. In state 300, the flipper rods 122" (FIG. 3) for the third bin 110" are activated causing the temporary stack 112" to fall to the platform 114" as shown in FIG. 4*h*.

Next, the third bin process 258 moves to a decision state 302 to test whether the programmed value for the compensate count of the third bin 110" has been reached. If the compensate count has been reached, the process 258 moves to a state 304 and causes the platform 114" to rotate through 180°.

If the compensate count was not reached at state 302 or after completion of the compensation at state 304, the process 258 moves to a state 306. At state 306, the stack on the platform 114" is compressed. After stack compression, the process 258 continues to a state 308 to test whether the programmed value for the total count of the third bin 110" has been reached. If the total count has been reached, control proceeds to a state 310 wherein a pusher assembly for the third bin 110" pushes the stack off of the platform 114".

After the stack has been pushed out for further handling at state 310 or if the total count for the third bin 110" (FIG. 3) has not been reached at state 308, the third bin process 258 moves to a state 312. At state 312, the diverter 140" for the third bin 110" is de-activated to the up position. The process 258 then continues to an end state 314 where the process for the third bin 110" terminates.

The system 100 ceases operation when the system power is turned off or when a product sensor (not shown) signals the control processor 132 (FIG. 1*a*) that there are no products on the conveyor 102 coming from the product source (not shown) after a preselected wait interval.

Figure 6:
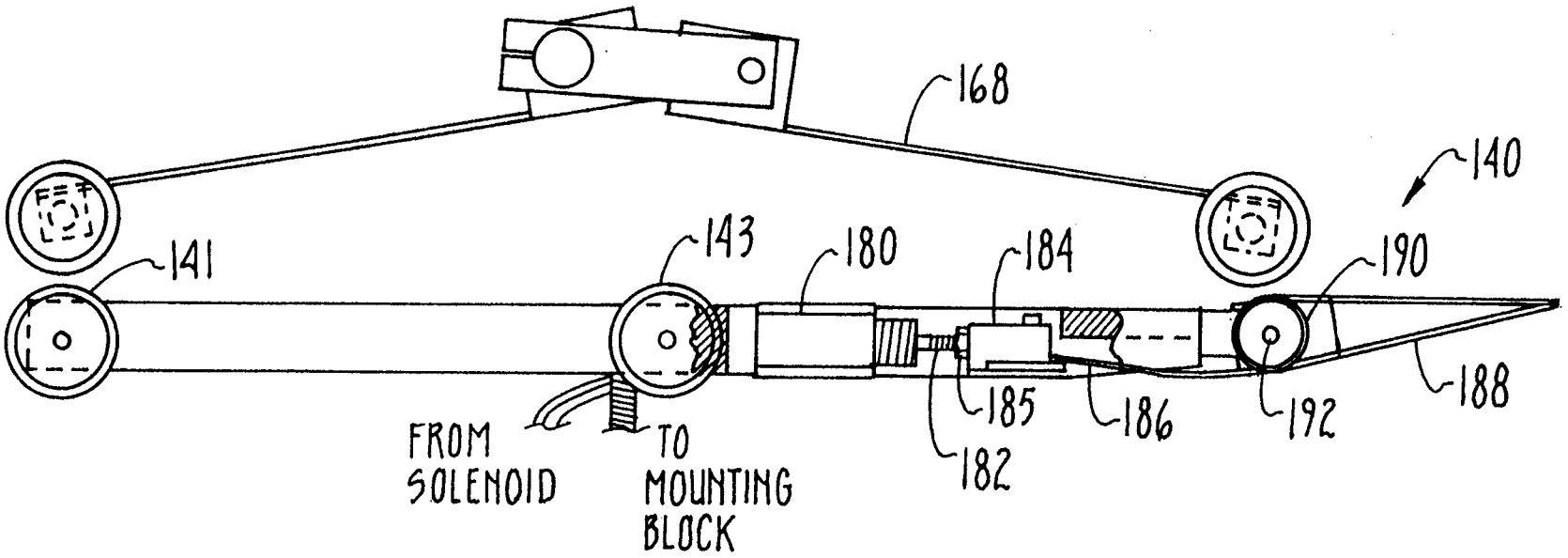
FIG. 6 is a schematic, side elevational view of the stream diverter shown in FIG. 1*a,* with a portion cut away.

The preferred, low profile stream diverter 140, including the top conveyor assembly 168, is shown in FIG. 6. A low profile is achieved by a novel arrangement of only three moving parts and a simplified actuating means.

Although not shown, a solenoid valve, connected to the main air supply via an air line and mounted on the system framework, actuates the cylinder 180. The diverter 140 is mounted on the system framework using a mounting block (not shown) that attaches to the bottom of the diverter 140 behind the upstream conveyor roller 143. The three moving parts include a cylinder 180, an actuating link 186 and the wedge 188. The cylinder 180 includes a cylinder shaft 182 which is screwed into a clamp assembly 184 and is locked on using a nut 185. The actuating link 186, which is made of a flat, flexible material, such as metal, is attached at one end to the upstream end of the clamp 184. In the preferred embodiment, the material and structure of the actuating link 186 is selected so as to form a spring. The other end of the actuating link 186 is attached to the lower surface of the wedge 188 at a point that is near tangential to a pair of bearings or pivot points 190 (only one is visible in FIG. 6) using a clamp block and screw assembly (not shown). The wedge 188 is pivotally secured between the two bearings 190 to a common axis 192 with the bearings.

When the control processor 132 activates the diverter 140, air pressure is supplied to one end of the cylinder 180 allowing the cylinder shaft 182 to provide power to the actuating link 186 and to thereby lower the wedge 188 to the horizontal or closed position. At a subsequent time, the control processor 132 deactivates the diverter 140 such that the other end of the cylinder 180 is provided with air pressure that forces the cylinder shaft 182 to extend causing the actuating link 186 to raise the wedge 188 to the open position. Of course, the pneumatic components could also be driven by hydraulic or other means.

The embodiments disclosed herein for a product handling system can be extended to any number of stacking bins. The modular system described herein allows the user to configure the system for as many stacking bins as necessary to accommodate consecutive, low quantity stacks without reducing the speed of the product source, such as the printing or binding line. The system provides for the compression and compensation of products as programmed by the user. The system allows for various product sizes through a plurality of adjustment means.

Although the invention has been described with reference to specific embodiments, the description is intended to be illustrative of the invention and is not intended to be limiting. Various modifications and applications may occur to those skilled in the art without departing from the true spirit and scope of the invention as defined in the appended claims.

What is claimed is:

1. A product handling system for an imbricated stream of products, each product having at least one connected edge, comprising:

a plurality of product stacking bins wherein each stacking bin includes a product size adjustment device;

a conveyor for moving the products from a product source to a first one of the stacking bins;

a gapper for selectively gapping the products on the conveyor, thereby providing a plurality of gapped imbricated product streams;

a plurality of diverters wherein each diverter selectively connects one stacking bin to the next stacking bin so that the stacking bins are serially connected, each diverter comprising a wedge connected to an actuating device coplanar to the conveyor in a low-profile assembly; and a control processor for controlling the activation of the gapper and the diverters;

whereby the combination of the low-profile diverter and the product size adjustment device allows for a plurality of product types to be quickly stacked in the plurality of stacking bins.

2. The product handling system defined in claim 1, wherein the product stacking bins are compensating stacking bins.

3. The product handling system defined in claim 1, wherein the product stacking bins are substantially identical.

4. The product handling system defined in claim 1, wherein the gapper includes an electrically activated pneumatic cylinder.

5. The product handling system defined in claim 1, wherein each diverter includes an electrically activated pneumatic cylinder.

6. The product handling system defined in claim 1, wherein each diverter includes a wedge connected to a stacker conveyor.

7. The product handling system defined in claim 1, wherein the control processor includes a programmable logic controller and a memory.

8. The product handling system defined in claim 1, additionally comprising a product sensor for sensing products on the conveyor.

9. The product handling system defined in claim 1, additionally comprising a high speed sensor for sensing the speed of the conveyor.

10. The product handling system defined in claim 1, wherein each stacking bin is adjustable to accept products of varying sizes.

11. The product handling system defined in claim 1, wherein the diverters are substantially identical.

12. The product handling system defined in claim 1, wherein the diverters and product stacking bins are modular so that system size is incrementally expanded by adding one diverter and one stacking bin.

13. The product handling system defined in claim 1, wherein any one diverter is located above any one stacking bin.

14. The product handling system defined in claim 1, wherein the location of each diverter is fixed along a line parallel to product stream flow so as to allow adjustment of the stacking bins.

15. The product handling system defined in claim 1, wherein the product size adjustment device can comprise a length adjustment and a width adjustment.

16. The product handling system defined in claim 1, wherein the control processor additionally provides control signals to the stacking bins.

17. A system for stacking products, wherein each product comprises at least one connected edge, comprising:

a plurality of identical product stacking bins wherein each stacking bin includes product size adjustment means;

means for receiving a plurality of overlapping products in a stream from a product source;

means for periodically gapping the stream so as to create a plurality of stacker streams, each stacker stream comprising a plurality of overlapping products;

means for periodically diverting one of the stacker streams to one of the stacking bins, the diverting means comprising a wedge connected to an actuating means coplanar to the receiving means; and a control processor for providing control signals to the gapping means and the diverting means.

18. The system defined in claim 17, wherein the product stacking bins are compensating stacking bins.

19. The system defined in claim 17, wherein the stacking bins are adjustable to accept products of varying sizes.

20. The system defined in claim 17, wherein the control processor additionally provides control signals to the stacking bins.

21. The system defined in claim 17, wherein the receiving means includes a conveyor.

22. The system defined in claim 17, wherein the receiving means includes a product sensor for sensing products in the stream.

23. The system defined in claim 17, wherein the gapping means includes an electrically activated pneumatic cylinder.

24. The system defined in claim 17, wherein the gapping means is active for approximately 50 milliseconds.

25. The system defined in claim 17, wherein the diverting means includes a plurality of diverters which selectively connect one stacking bin to the next stacking bin so that the stacking bins are serially connected.

26. The system defined in claim 25, wherein the diverters are substantially identical.

27. In the system defined in claim 25, a method of adding a stacking bin and a diverter to thereby increase the size of the system.

28. The system defined in claim 25, wherein the diverters are coplanar to one another.

29. The system defined in claim 25, wherein each diverter is active for approximately 15 milliseconds.

30. The system defined in claim 25, wherein each diverter includes an electrically activated pneumatic cylinder.

31. The system defined in claim 25, wherein each diverter includes a wedge connected to a stacker conveyor.

32. The system defined in claim 17, additionally comprising a high speed sensor for sensing the speed of the receiving means.

33. The system defined in claim 17, wherein the system operates independent of the speed of the product source.

34. The system defined in claim 17, additionally comprising a product counter that sends a signal to the control processor.

35. The system defined in claim 17, wherein the control processor includes a controller and a memory.

36. The system defined in claim 35, wherein a product count for each stacking bin is stored in the memory.

37. The system defined in claim 17, wherein the product stacks are of a low quantity.

38. The system defined in claim 37, wherein the quantity of any one stack is in the range of one to seventeen products.

39. The product handling system defined in claim 17, wherein the diverter means includes a plurality of diverters and any one diverter is located above any one stacking bin.

40. The product handling system defined in claim 17, wherein the location of the diverter means is fixed relative to the bin center position so as to accommodate different product sizes.

41. The system defined in claim 17, wherein the product size adjustment means can comprise a length adjustment and a width adjustment.

42. In a system having a gapper, and a plurality of substantially identical adjustable stacking bins and diverters, wherein each diverter comprises a wedge and an actuating device, a method of forming a plurality of product stacks from an imbricated product stream, wherein each product comprises at least one connected edge, the method comprising the steps of:

adjusting the size of the stacking bins according to the size of he product;

accumulating products from the product stream in a first one of the stacking bins, thereby forming a first stack;

activating a first one of the diverters at a first predetermined point in the product stream;

translating linear motion of the first diverter activating device to rotational motion of the wedge;

conveying a portion of the product stream downstream of the first activated diverter, said portion comprising imbricated products, accumulating products from the product stream portion in a second one of the stacking bins, thereby forming a second stack;

actuating the gapper to gap the product stream at a second predetermined point in the product stream;

activating a second one of the diverters at a third predetermined point in the product stream;

translating linear motion of the second diverter activating device to rotational motion of the wedge;

conveying a portion of the product stream downstream of the second activated diverter; and accumulating products from the product stream in a third one of the stacking bins, thereby forming a third stack.

43. The method of forming product stacks defined in claim 42, wherein each stacking bin comprises a compensating stacking bin.

44. The method of forming product stacks defined in claim 42, wherein each diverter comprises a wedge connected to a stacker conveyor.

45. The method of forming product stacks defined in claim 42, additionally comprising the step of initializing and incrementing a product count for each one of the stacking bins.

46. The method of forming product stacks defined in claim 42, wherein the accumulation step includes the steps of:

creating a temporary stack; and forming one of the stacks from one or more temporary stacks.

47. The method of forming product stacks defined in claim 42, additionally comprising the step of deactivating the first diverter at a fourth predetermined point in the product stream.

48. The method of forming product stacks defined in claim 42, additionally comprising the step of deactivating the second diverter at a fifth predetermined point in the product stream.

49. The method of forming product stacks defined in claim 42, wherein system size is increased by adding at least one each of substantially identical modular stacking bins and diverters.

50. The method of forming product stacks defined in claim 42, wherein ay one diverter is located above any one stacking bin.

51. The method of forming product stacks defined in claim 50, additionally comprising the step of maintaining the location of the diverter relative to the center of the stacking bin to accommodate different product sizes.

* * * * *